US007562622B2

(12) United States Patent
Babiel et al.

(10) Patent No.: US 7,562,622 B2
(45) Date of Patent: Jul. 21, 2009

(54) MANUALLY OPERATED PRESS HAVING AN OVERLOAD PROTECTION

(75) Inventors: Hartmut Babiel, St. Georgen (DE); Peter Sutermeister, Villingen-Schwenningen (DE)

(73) Assignee: Gebr. Schmidt Fabrik fuer Feinmechanik GmbH & Co. KG, St. Georgen (DE)

( * ) Notice: Subject to any disclaimer, the term of this patent is extended or adjusted under 35 U.S.C. 154(b) by 0 days.

(21) Appl. No.: 12/013,091

(22) Filed: Jan. 11, 2008

(65) Prior Publication Data

US 2008/0173191 A1 Jul. 24, 2008

Related U.S. Application Data

(63) Continuation of application No. PCT/EP2006/006717, filed on Jul. 10, 2006.

(30) Foreign Application Priority Data

Jul. 13, 2005 (DE) ..... 10 2005 034 424

(51) Int. Cl.
*B30B 15/14* (2006.01)
*B30B 1/24* (2006.01)
*B30B 15/10* (2006.01)
*B30B 15/12* (2006.01)

(52) U.S. Cl. ..... 100/346; 100/35; 100/43; 100/266; 100/288

(58) Field of Classification Search ..... 100/35, 100/43, 48, 49, 50, 346, 219, 260, 262, 265, 100/266, 282, 288, 290; 72/441, 444; 192/12 C, 192/18 A, 12 D
See application file for complete search history.

(56) References Cited

U.S. PATENT DOCUMENTS

| | | | | |
|---|---|---|---|---|
| 2,533,279 | A | 12/1950 | Moore et al. | |
| 3,686,922 | A | 8/1972 | Bley | |
| 5,383,263 | A | 1/1995 | Sakar | |
| 6,755,124 | B2 | 6/2004 | Schubert | |
| 7,080,595 | B2 | 7/2006 | Babiel et al. | |
| 2001/0022142 | A1 | 9/2001 | Schubert | |
| 2004/0003729 | A1 * | 1/2004 | Aoshima | 100/35 |
| 2005/0115292 | A1 | 6/2005 | Babiel et al. | |

FOREIGN PATENT DOCUMENTS

| | | |
|---|---|---|
| DE | 199 59 627 A1 | 6/2001 |
| DE | 102 23 153 C1 | 7/2003 |

(Continued)

*Primary Examiner*—Jimmy T Nguyen
(74) *Attorney, Agent, or Firm*—Harness, Dickey & Pierce, P.L.C.

(57) ABSTRACT

A manually operated press comprises an actuation lever coupled to a shaft assembly. An actuation of the actuation lever is transformed into a stroke movement of a press ram. A clutch assembly is provided for interrupting a flow of force between the actuation lever and the press ram. The clutch is adapted to separate an input shaft from an output shaft depending on predetermined pressing parameters. The input shaft extends as an inner shaft through the output shaft. The clutch assembly has a first clutch designed as a stroke stop for immobilizing the input shaft with a press housing depending on the pressing parameter, and a second clutch designed as an overload clutch for interrupting a flow of force between the input shaft and the output shaft.

22 Claims, 2 Drawing Sheets

FOREIGN PATENT DOCUMENTS

| | | | |
|---|---|---|---|
| EP | 0 622 175 | A1 | 11/1994 |
| JP | 11-230191 | | 8/1999 |
| JP | 2004-337897 | | 12/2004 |
| WO | WO 98/35823 | | 8/1998 |
| WO | WO 03/097339 | A1 | 11/2003 |
| WO | WO 2007/006523 | | 1/2007 |

* cited by examiner

MANUALLY OPERATED PRESS HAVING AN OVERLOAD PROTECTION

CROSS REFERENCE TO OTHER APPLICATIONS

The present application is a continuation of pending International patent application PCT/EP2006/006717, filed Jul. 10, 2006 which designates the United States and was published in German, and which claims priority of German patent application 10 2005 034 424.0, filed Jul. 13, 2005. The disclosure of the above applications is incorporated herein by reference.

FIELD OF THE INVENTION

The present invention is related to the field of manually operated presses which are conventionally used for pressing workpieces together.

The invention, further, is related to a method for protecting a manually operated press against mechanical overload and for aborting an insufficiently executed pressing operation.

More specifically, the invention is related to a manually operated press comprising an actuation member coupled to a shaft, an actuation of the actuation member being transformed into a stroke movement of a press ram coupled to the shaft and, accordingly, into a change of a relative displacement position of the press ram, and a clutch for interrupting a flow of force between the actuation member and the press ram.

BACKGROUND OF THE INVENTION

U.S. Pat. No. 7,080,595 B2 discloses a manually operated press into which a backstroke inhibitor is electronically implemented, such as known e.g. from U.S. Pat. No. 6,755,124 B2.

Manually operated presses of the kind described above are conventionally used for piece-work workplaces. As in manually operated presses the exerted force increases towards the end of the pressing stroke, some operating persons tend to exert too much force and, thereby, produce pressed workpieces of bad quality or even damaged workpieces.

For many conventional manually operated presses no documentation is produced, in contrast to automatically executed pressing operations for which numerically controlled presses are conventionally used. The lack of documentation, however, is nowadays no longer acceptable for many fields of application, in particular when production processes are to be certified under the ISO 9000 standard.

In order to make sure that one can distinguish between "good" and "bad" parts, European patent specification 0 960 017 B1 teaches to provide a press with a sensor for the pressing stroke (displacement position) as well as with another sensor for the pressing force for generating a displacement-force diagram for any pressing operation being characteristic for a good and for a bad pressing. If a measured displacement-force curve lies within a given tolerance band, then the respective part is identified as well pressed. If not, the part is identified as a bad part that must be disposed of.

In order to be able to determine the pressing force exerted during a pressing operation, e.g. on a Seeger circlip ring, a bearing, a pinion, a sealing etc., a press ram of the press is configured as a force sensor. The force sensor has a force measuring system, for example a strain gauge strip, integrated therein. The strain gauge is connected to a press control unit of the press which, in turn, may be connected with a rotation sensor, for example, for sensing the rotation angle of the actuation lever and, hence, the ram displacement position. The control unit then processes the sensed data to enable the above-mentioned differentiation between good and bad parts once the pressing operation is executed.

If the examination shows that a bad part was pressed, the press may switch off automatically when the bad part is still within the press. This is likewise made upon a respective command from the control unit.

To start with, there is a first problem that during conventional manual pressing operations, in contrast to automatically executed pressing operations, there may unintentionally occur high pressing forces which, for example, are caused by negligence of the operating person. High pressing forces may likewise occur when the parts which are to be pressed together, are already sufficiently joined, however, the mechanical final position of the pressing stroke has not yet been reached. In such a situation, the operating person "feels" that the actuation lever may still be moved further in the pressing direction, and, therefore executes such movement to its end. In such a case a too high pressing force may be executed resulting in a "bad" pressing.

It is, therefore, necessary that the exerted pressing force be measured as precisely as possible in order to be able to optimally execute the quality examination based thereon. For that purpose highly sensitive force measuring systems are used which, however, are destroyed or at least damaged at too high mechanical overloads. Moreover, high overloads may occur from time to time that exceed admissible overload specifications by 100 or 200%.

As already mentioned above, the prior art teaches to record the force as a function of the displacement position for making a quality evaluation (good/bad) once the pressing operation is finished. As the pressing operation is effected manually, each pressing operation is effected with different pressing force. For that reason some work pieces which shall be pressed together, may already be joined sufficiently "well" before the press ram has reached its mechanical final position, or some work pieces may be sufficiently joined only at the final position. In the event that the sufficient joining has already been achieved prematurely, it would be desirable to abort the pressing operation before the final (mechanical) press ram position has been reached.

SUMMARY OF THE INVENTION

It is, therefore, an object underlying the invention to improve a manually operated press of the type specified at the outset such that the above-discussed problems are avoided. In particular, a manually operated press shall be provided in which admissible overloads can be limited to a predetermined threshold value, and in which a force sensor is protected against overload. Moreover, the pressing operation shall be aborted prematurely in the event that the desired pressing force has been reached prematurely. "Bad" pressings shall be avoided.

In a press of the type specified at the outset, this object is achieved according to the invention in that the lever shaft is at least a two-piece construction, namely configured with an input shaft and an output shaft, and that the clutch is adapted to separate the input shaft from the output shaft depending on the pressing force and/or the relative displacement position of the press ram.

The object underlying the invention is, thereby, entirely solved.

Due to the fact that in contrast to the prior art the shaft of the invention is configured two-piece, one now has, unlike before, the option to interrupt the flow of force between the actuation member and the press ram at will, namely independent from the effective actuation of the actuation member. The prior art until now only teaches to brake or to immobilize a one-piece shaft upon occurrence of a failure, in particular when the back stroke is initiated prematurely.

According to the present invention the flow of force between the press ram and the actuation lever can be interrupted at any moment in time by means of the clutch, namely by separating the shafts from each other. In the event that a desired pressing force is exerted already before a (mechanical) final position of the pressing operation has been reached, the shafts may be separated from each other depending on that event. If an inadmissibly high pressing force is exerted during a pressing operation which would damage a force sensor or would result in a "badly" pressed work piece, the shafts could likewise be separated from each other, again—depending on these events.

For that purpose it is advantageous to additionally provide a first sensor for sensing the pressing force and/or a sensor for sensing the relative position of the press ram.

If only a pressing force sensor is provided, a force measuring system of the press can be protected against overload. Should only a sensor for sensing the relative position of the press ram be provided then one can determine from the executed stroke displacement which pressing force was exerted, provided that all required further parameters as needed therefore are known, as, for example, the transmission of the lever movement into the press stroke, properties of the work pieces to be pressed together, etc.

If both sensors are used in combination, one can record a force vs. displacement curve for each pressing operation so that it is possible to make a good/bad distinction already during the course of the pressing operation. In particular, one may determine when a "good" pressing has occurred. If the force is recorded vs. the displacement, one can, for example, decide by means of a higher level control that the pressing operation shall be aborted already before a (mechanical) final position of the press ram has been reached, because a desired pressing force has been reached. In such a way "bad" pressings are generally avoided.

Preferably, a control unit is provided for that purpose which is coupled to the first and/or the second sensor and also to the clutch for supplying respective clutch signals to the clutch.

The control unit samples the force sensor(s) for outputting clutch signals to the clutch as a response to signals produced by the sensors.

The control unit, preferably, outputs a clutch signal for keeping the clutch closed when the sensed pressing force or the sensed relative displacement position of the press ram is smaller than a predetermined threshold value.

When the clutch is open, no flow of force may occur between the actuation member and the press ram. If the actuation member is not in its predetermined initial position, a pressing operation is not allowed at all due to the open clutch. This enhances pressing safety.

It is, further, preferred, when the control unit supplies a clutch signal for opening the clutch when the pressing force or the relative displacement position of the press ram is greater than or equal to a predetermined threshold value. The threshold value may be an admissible maximum pressing force, at which a force sensor is not damaged, and/or may be a minimum pressing stroke displacement at which a "good" pressing is obtained.

The control unit is, in particular, provided with means for determining whether a predetermined pressing force limit was exceeded or a desired pressing force has been reached. If the limit is exceeded, then a signal for opening the clutch is generated. Thereby, the flow of force between the actuation member and the press ram is interrupted.

According to a preferred embodiment of the invention, the manually operated press is provided with a stroke stop for immobilizing the input shaft, wherein the stroke stop, in particular, comprises a brake disc and a brake magnet.

With a stroke stop so configured the actuation of the actuation member may be immobilized in the forward as well as in the backward direction. The actuation lever is rigidly connected with the input shaft, such that an immobilization of the input shaft results in an immobilization of the actuation lever.

In a preferred configuration of the stroke stop using a brake disc cooperating with a brake magnet, the brake disc is, preferably, secured against rotation to the input shaft, and the brake magnet is secured in a stationary manner to the press. Considering that the stroke stop in that case is an electrically operated brake assembly, the brake assembly may likewise be controlled by the above-mentioned control unit, by sending corresponding signals from the control unit to the stroke stop or its elements.

Further, it is preferred when a third sensor is provided for sensing the relative displacement position of the input shaft, wherein the brake disc may be configured such that the third sensor senses the relative displacement position in cooperation with the brake disc.

By means of the third sensor one can generate a signal according to which the clutch is closed, provided that the actuation member is in its corresponding initial position. The initial position may be sensed by means of the brake disc or a disc flange, being connected to the input shaft for rotation therewith and, hence, also to the actuation member. Thereby it is always guaranteed that the flow of force is only established between the actuation lever and the press ram when the actuation lever is in its initial position. Hence, it is guaranteed that the displacement that can be made by the actuation lever is sufficient to effect the press stroke required for making a sufficient pressing operation. In particular, the clutch is closed only when also the press ram is in its initial position.

Further, it is advantageous when a return assembly, in particular a spring, is provided being coupled to the input shaft.

By this measure one may effect that the actuation member is automatically moved back into its initial position, in particular when the clutch is separated, i.e. the flow of force between the actuation member and the press ram is opened and the operating person may have released the actuation lever. For an automatic return movement of the actuation lever it is, of course, necessary that the stroke stop is not immobilized.

According to another preferred embodiment of the invention, the actuation member is a manually operable lever, the input shaft is an inner manual lever shaft and the output shaft is an outer hollow shaft.

By this measure one can obtain a manually operated press with short dimensions because the input shaft constitutes an inner shaft being arranged coaxially to the outer hollow shaft.

In particular, the second sensor may be a linear incremental displacement position measuring system sensing displacement position marks coupled to the press ram.

By coupling the position marks to the press ram, the measurement of the effected displacement is made on the press ram without any inaccuracies caused e.g. by transmissions, in contrast to the prior art where the displacement is sensed by means of a rotary sensor at the input shaft.

Here, too, it is advantageous when the two shafts are interconnected by the clutch in a form-fitting manner for transforming the stroke movement. By the additional form-fitting connection one can constitute a mechanical overload protection in which spontaneous overloads of (very) high intensity can be absorbed before they destroy a force sensor.

For that purpose one preferably uses a toothing having a latch position being configured such as to open automatically from a closed state at a predetermined torque that is effected via the actuation member. The latch position is, preferably, reached when the shafts are in their respective initial positions.

If, suddenly, an inadmissibly high torque appears at the shafts being coupled by the toothing, an automatic separation of the coupling is effected by this kind of coupling. The closing force exerted by the clutch is no more sufficient for compensating a decoupling force caused by the toothing. In that case the clutch opens spontaneously, i.e. without the intervention of a higher level control, for interrupting the flow of force.

It will be understood that the features of the invention mentioned above and those yet to be explained below can be used not only in the respective combination indicated, but also in other combinations or in isolation, without leaving the scope of the present invention.

BRIEF DESCRIPTION OF THE DRAWINGS

Exemplary embodiments of the invention are explained in more detail in the following description and are represented in the drawings, in which.

DETAILED DESCRIPTION OF THE PREFERRED EMBODIMENTS

Figure 1:
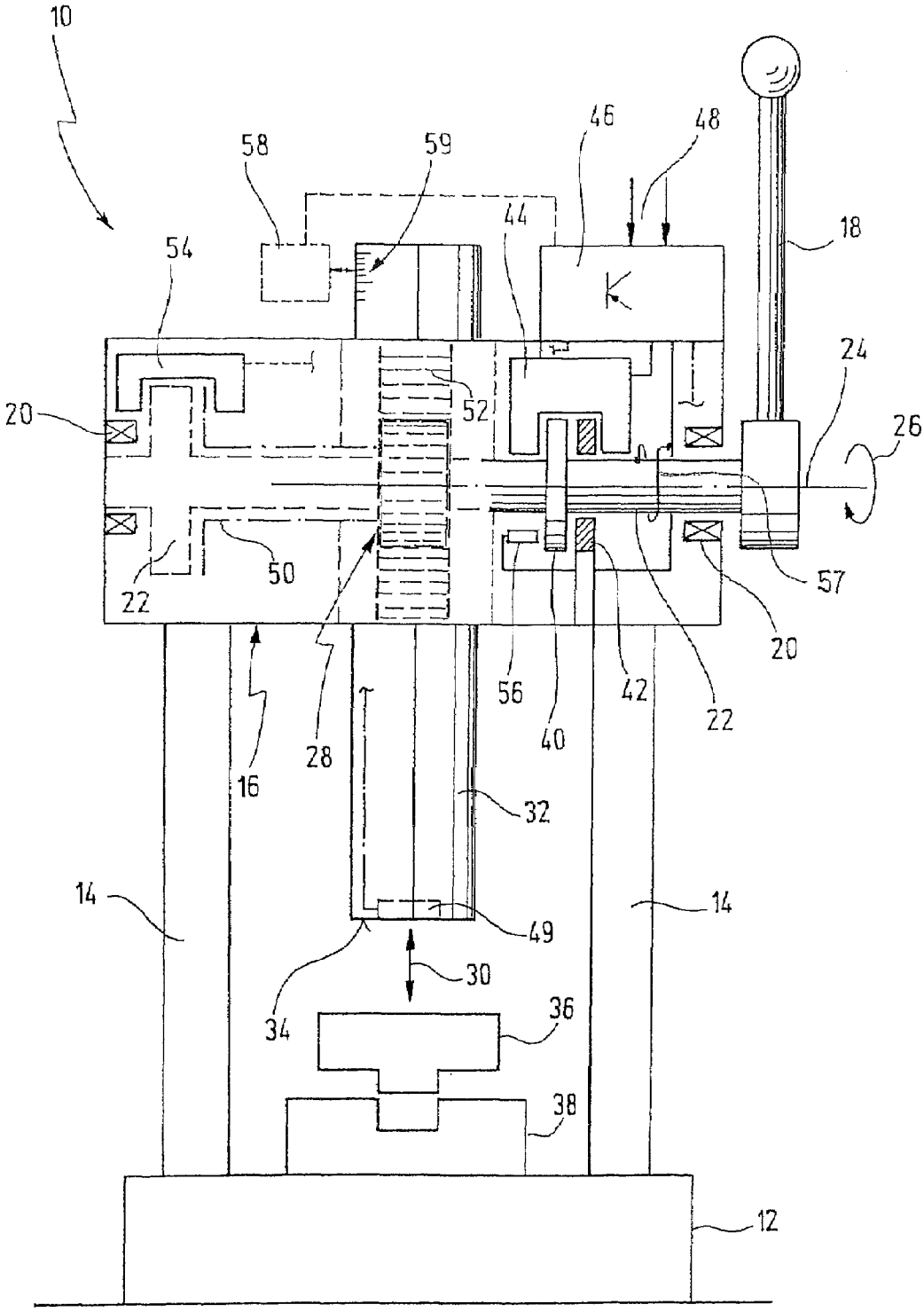
FIG. 1 shows a highly schematical side elevational view (partially broken away) of an embodiment of a manually operated press according to the present invention.

In FIG. 1 reference numeral 10 as a whole designates a manually operated press of essentially known design.

Press 10 has a base member 12 standing on an appropriate base, for example a work bench. Posts 14 extend upwardly from base member 12 to a head member 16, also referred to as shifting member because head member 16 is adapted to be adjustable in the direction of posts 14 depending on the desired stroke. An actuation lever 18 is arranged laterally at head member 16 and is connected to a shaft 22 journalled within shifting member 16 by means of bearings 20. Shaft 22 is adapted to be rotated about its axis 24 by actuation lever 18, as indicated by an arrow 26. FIG. 1 shows the initial position of lever 18.

A transmission 28 shown extremely schematically is provided within shifting member 16. Transmission 28, in the simplest case, may be a pinion-rack assembly. The assembly is provided for transmitting the rotary movement of shaft 22 into a vertical stroke movement of a press ram 32 as indicated by an arrow 30.

During a pressing operation, the lower front surface 34 of press ram 32 comes to rest on an upper work piece 36 of a pair of work pieces 36, 38 which shall be pressed together.

Press 10 is provided with a brake disc 40 being rigidly connected for rotation with shaft 22. Immediately adjacent brake disc 40 there is provided a second disc 42 configured as a ring for allowing shaft 22 to be guided through second disc 42. Second disc 42 is rigidly connected to shifting member 16 and, therefore, is hereinafter referred to as stationary.

Reference numeral 44 designates a first clutch having a brake magnet being electrically connected to an electronic control unit 46. Control signals may be fed from outside, for example from a numerical control unit, to electronic control unit 44 via inputs 48 for constituting an electronic back stroke stop as disclosed in U.S. Pat. No. 7,080,595 B2. This function is likewise possible with the present press 10. For further details reference is made to U.S. Pat. No. 7,080,595 incorporated herein by way of reference.

The stroke stop configured by first clutch 44 is essentially characterized by the magnet clutch effect of electro magnet exerted on clutch discs 40 and 42. This "magnetic brake" may, however, be likewise constituted by a pneumatic or a hydraulic brake interconnecting discs 40 and 42 in a frictional manner for preventing a rotation of shaft 22 about its axis 24.

Press ram 32 may be provided with a force sensor 49 by which the actually effective pressing force may be sensed. Force sensor 49, too, is connected to electronic control unit 46. Press ram 32 may insofar serve as a force sensor for a strain gauge strip integrated therein. Sensor 49, however, may likewise be provided at another location, for example at base member 12.

Other force measuring systems, for example inductive force sensors or magnetoelastic force sensors or piezo-electric sensors etc. may likewise be used.

Insofar, press 10 is of conventional design.

In contrast to prior art presses, press 10 is provided with a second (outer) hollow shaft 50 being journalled coaxially to shaft 22. First shaft 22 is hereinafter referred to as the inner manual lever shaft because it is guided through outer hollow shaft 50. Outer hollow shaft 50 is directly connected to a toothed wheel or pinion constituting the transmission designated 28. Press ram 32 has corresponding teeth 52 meshing with the pinion or toothed wheel of outer hollow shaft 50. Preferably, the teeth of outer hollow shaft 50 and of press ram 32 engage one another directly. However, one could also provide further transmission elements therebetween.

Outer hollow shaft 50 can be connected to inner manual lever shaft 22 in a form-fitting or a frictional manner via a second clutch 54, preferably an electromagnetic clutch. Second clutch 54 is also connected to electronic control unit 46.

Inner manual lever shaft 22 constitutes an input shaft that is coupled to outer hollow shaft 50 via second clutch 54.

The operation of press 10 according to the present invention shall now be explained in further detail.

By means of a third sensor 56 being, for example, located near brake disk 40 and cooperating with the latter, one can determine the relative position of manual lever shaft 22. For that purpose, sensor 56 may likewise be connected to electronic control unit 46. As actuation lever 18 is connected to shaft 22 (for rotation therewith), as is also disc 40, one can, therefore, also draw conclusions on the position of lever 18.

If it is determined that manual lever shaft 22 as well as press ram 32 are in their respective initial positions, from which on a pressing operation may be initiated, a signal is outputted from control unit 46 to second clutch 54, such that second clutch 54 closes, i.e. inner shaft 22 and outer shaft 50 are connected with one another at least frictionally. Thereby, a flow of force is possible between lever 18 and press ram 32.

Thereupon, lever 18 is rotated in the direction of arrow 26 for pressing work pieces 36 and 38 together.

Under normal conditions, i.e. when no inadmissibly high pressing force occurs, that can be measured with force measuring system 49, lever 18 and, hence, also press ram 32 eventually reaches its (electronic or mechanical) final position. The mechanical final position is reached when press ram 32 has run through the maximum possible press stroke, or when lever 18 has been moved against a corresponding mechanical stop. The electronic final position has been reached when either lever 18 has been rotated about a predetermined angle or when press ram 32 has run through a predetermined (stroke) displacement.

The electronic final position could on the one hand be detected by sensor 56 by configuring brake disc 40, for example, in an area corresponding to the final position such that stationary sensor 56 could detect the final position. If an inductive sensor is used as sensor 56, brake disc 40 in this area could be configured more or less thick in axial direction 24.

The electronic final position could also be defined such that a desired pressing force (depending on the displacement of press ram 32) has been reached, i.e. work pieces to be pressed together have been sufficiently "well" be pressed together. For that purpose a distance or displacement measuring system 58 can be provided depicted schematically in FIG. 1 as a dashed line. The displacement measuring system detects displacement position marks 59 coupled to press ram 32.

When the final position has been reached, control unit 46—depending on the pressing force and/or the effected stroke displacement—can cause second clutch 54 to open, whereby the flow of force between lever 18 and press ram 32 is interrupted. Ram 32 can, in particular, be returned to its initial position corresponding to the initial position of lever 18, by means of a gas spring not shown in FIG. 1. It is advantageous when press ram 32 is coupled with displacement mark 59 for determining the relative position of press ram 32 because conclusions may be drawn from that information with regard to the pressing force that has been reached. By determining the relative position of press ram 32 one can, moreover prevent that a subsequent pressing operation is effected before press ram 32 is in its initial position.

This additional displacement measuring system 58 could be configured as a linear incremental measuring system having, for example, a resolution of 5 μm. Displacement marks 59 can be sensed by a measuring head being, preferably, positioned within head member 16 and being likewise connected to control unit 46.

Brake disc 40 may be connected to a return assembly, in particular a spring 57. The spring 57 is then connected to stationary head member 16. In the initial position, the spring 57 is biased. In the final position it is tensed such that, if an operating person should let lever 18 loose, lever 18 is returned automatically into its respective initial position. For that purpose, second clutch 54 should be open.

As soon as press ram 32 and lever 18 have reached their respective initial positions, a new pressing operation can be performed.

In the event that during a pressing operation the admissible pressing force is exceeded so that there is the risk of a damage on the force measuring system 49, the invention allows to open second clutch 54 before the final position of the pressing operation has been reached. In that case the flow of force between lever 18 and press ram 32 is interrupted. The force may no more act on force sensor 49. Force sensor 49 is, hence, protected against overload.

Similarly, a prematurely completed pressing operation that has been classified "good", may be terminated. This means that the flow of force is also interrupted if the pressing operation has been completed before the final position has been reached. The pressing force exerted via actuation lever 18 can be registered by means of sensor 49 by (higher level) control 46. Control 46 may, for example, comprise an appropriately prepared microprocessor. In the event that control unit 46, on the basis of a force-displacement measurement, determines that the work pieces 36 and 38 to be pressed together have actually been combined "well", control unit 46 interrupts the flow of force between lever 18 and ram 32 by means of an appropriate signal for second clutch 54.

The displacement measurement in this case is, preferably, effected via linear incremental displacement measuring system 58.

The pressing operation may also be aborted solely depending on the relative position of press ram 32 without actually measuring the pressing force. For that purpose, however, it is necessary that the force-displacement characteristics of the press be known so that one can determine solely on the basis of the stroke displacement whether or when a "good" pressing has been obtained.

In order to avoid the operating person moving lever 18 "into emptiness", which could result in injury to the operating person, the first clutch 44 is, preferably, actuated first.

More specifically, this is effected as follows: Force sensor 49 senses the pressing force exerted via lever 18; the sensed pressing force is sampled in predetermined time intervals by control unit 46; subsequently, control unit 46 determines, whether there is an inadmissibly high pressing force that would damage force sensor 49, by determining, for example, whether the sensed pressing force is greater as or equal to a predetermined threshold value, or, when a "good" pressing of work pieces 36 and 38 has occurred (for example a desired pressing force has been reached); if the sensed pressing force exceeds the predetermined threshold value or if the desired pressing force has been reached, control unit 46, preferably, first outputs a signal for first clutch 40 to stop the movement of lever 18 more or less abruptly; subsequently a clutch signal is outputted by control unit 46 for second clutch 54 for opening second clutch 54; second clutch 54 opens; the flow of force between lever 8 and press ram 32 is, hence, interrupted; as an option, the brake may be released again.

Similar considerations apply when only the stroke displacement is measured.

Depending on whether the operating person still operates lever 18, lever 18 can be moved further to the mechanical stop, without, however, being in frictional connection with press ram 32, so that there is no danger of damaging force sensor 49. Or, the operating person has already let lever 18 go. If the operating person has let lever 18 go, and if there is the above-mentioned return assembly between brake disc 40 and head member 16, then lever 18 will automatically return into its initial position.

In the switched-off condition of press 10 there is, preferably, no connection between lever 18 and press ram 34 which results in a higher process safety. For making a connection, second clutch 54 must first be energized with current. It goes, however, without saying that second clutch 54 could operate just the other way round, i.e. second clutch 54 could also be closed in the non-activated condition, wherein control unit 46 first interrupts such connection before a pressing operation can be effected and then makes the above-mentioned check on the initial position. In such a way it is always guaranteed that the respective initial positions of lever 18 and of press ram 32 are assumed at the beginning of a pressing operation.

Instead of the type of transmission mentioned at the outset in which a rack meshes with a pinion or a toothed wheel, one might also use a planetary gear train, a worm drive, a chain drive, a belt drive a conical wheel drive, a toggle lever, a shoe lever, a hydraulic transmission or the like.

According to another embodiment of the present invention, inner manual lever shaft 22 and outer hollow shaft 50 are not only interconnected frictionally but also in a form-fitting manner.

Figure 2:
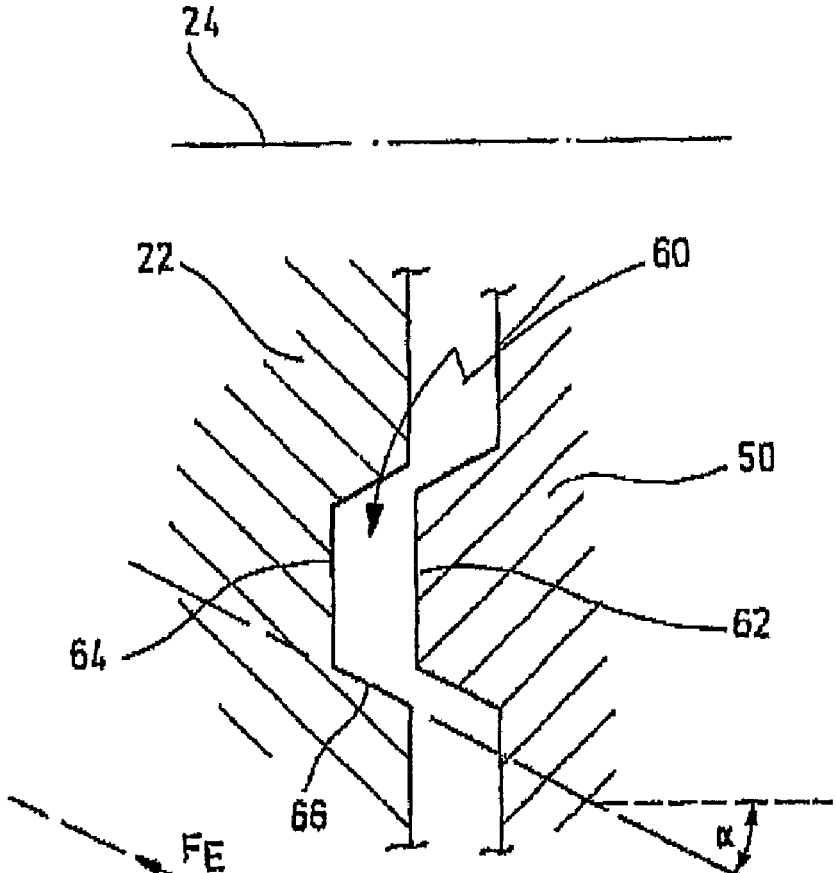
FIG. 2 shows a latch toothing of a first and of a second shaft section according to the present invention.

FIG. 2 shows a highly schematic cross-sectional view perpendicularly to a coupling plane between inner manual lever shaft 22 and outer hollow shaft 50.

The drawing plane of FIG. 2 corresponds to the plane extending perpendicular to the drawing plane of FIG. 1. The tooth pair 60 shown in FIG. 2, preferably, comprises one (latch) tooth 62 only which, in the embodiment shown is configured with outer hollow shaft 50, and a corresponding recess 64 in inner manual lever shaft 22. FIG. 2 shows a condition, in which second clutch 54 (cf. FIG. 1) is open, such that shafts 22 and 50 may freely be rotated with respect to each other. Should second clutch 54 close, shafts 22 and 50 will move relatively towards each other along axis 24 such that tooth 62 comes into engagement with recess 64.

It goes without saying that tooth 62, as an alternative, can also be configured with inner manual lever shaft 22 and recess 64 at outer hollow shaft 50. Instead of one tooth pair only, several such pairs 62, 64 could also be provided. Embodiments with one (latch) tooth, however, are preferred as will be explained further below.

Tooth pair 60 may, additionally, be used for determining the initial position of press ram 32. This means that only if shafts 22 and 50 are correctly oriented relative to one another, i.e. if hollow shaft 50 and, hence, press ram 32 are in their initial position, then tooth 62 and recess 64 may engage. If press ram 32 is not (yet) in its initial position, no coupling between shafts 22 and 50 is possible.

Figure 3:
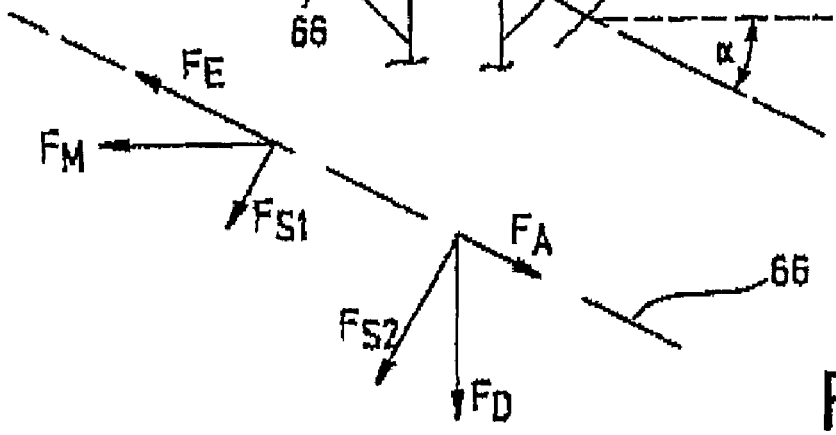
FIG. 3 shows a schematic force ratio at the location of the toothing according to FIG. 2.

Further, in FIG. 3 there are schematically shown forces acting on shafts 22, 50 and their respective tooth, recess 62, 64, pair along a tooth flange extending parallel to an imaginary line 66.

Assuming that for closing second clutch 54 (cf. FIG. 1), a magnetic force $F_M$ (FIG. 3) is required for, for example, moving outer hollow shaft 50 or its tooth 62, in the direction of inner hollow shaft 22 or its recess 64. The (closing) force $F_M$ of the clutch magnet may be resolved with the help of a force parallelogram into two force components $F_E$ and $F_{S1}$, wherein $F_E$ represents the coupling force acting along imaginary line 66 and $F_{S1}$ represents the force acting perpendicularly to the toothing flange.

If both shafts 22, 50 are coupled with each other and actuation lever 18 is actuated by an operating person, inner manual lever shaft 22 will transmit a rotary force $F_D$ onto outer hollow shaft 50 as is also shown in FIG. 3. Rotary force $F_D$ may likewise be resolved into two force components $F_A$ and $F_{S2}$, wherein $F_A$ represents the decoupling force and $F_{S2}$ represents the force acting perpendicularly to the tooth flange.

As long as the rotary force does not exceed a certain threshold value, decoupling force component $F_A$ is smaller than coupling component $F_E$. If, however, the operating person (spontaneously) exerts a very high force onto shaft 22, rotary force $F_D$ will increase abruptly, resulting in an increase of decoupling force FA. If force component $F_A$ becomes greater than force component $F_E$, an opening of tooth pair 60 results even if clutch 54 is closed or not yet opened. The force at which tooth pair 60 opens automatically depends on its design parameters, in particular on the flange angle $\alpha$. Second clutch 54 then acts as an overload clutch.

With this measure one can effect that, if a spontaneous torques occur which cannot be compensated for at that speed by the control unit, the coupling between shafts 20, 50 opens automatically. This, in turn, means that the flow of force between actuation lever 18 and press ram 32 is separated such that a force sensor is again protected against overload.

Instead of a tooth pair one could likewise use rollers or the like.

The invention claimed is:

1. A manually operated press comprising a shaft assembly having at least two-separated pieces, said at least two separated pieces comprises an input shaft and an output shaft, said input shaft extending as an inner shaft through said output shaft, said output shaft is being configured as a hollow shaft, a manual actuation member coupled to said shaft assembly, a manual actuation of said actuation member being adapted to be transformed into a stroke movement of a press ram coupled to said shaft assembly, said press ram is configured to press a work piece positioned on a base, and a clutch assembly having a first clutch designed as a stroke stop for immobilizing said input shaft with a housing of said press depending on at least one press parameter of a group of press parameters comprising pressing force and relative displacement position of said press ram, and a second clutch designed as an overload clutch for interrupting a flow of force between said input shaft and said output shaft.

2. The manually operated press of claim 1, wherein a first sensor is provided for sensing said pressing force.

3. The manually operated press of claim 2, wherein a control unit is provided coupled to said clutch assembly and, further, to said first sensor for supplying clutch signals to said clutch assembly.

4. The manually operated press of claim 3, wherein said control unit supplies a clutch signal for keeping said second clutch closed when said sensed pressing force is smaller than a predetermined threshold value.

5. The manually operated press of claim 3, wherein said control unit supplies a clutch signal for opening said second clutch when said pressing force is greater than or equal to a predetermined threshold value.

6. The manually operated press of claim 1, wherein a second sensor is provided for sensing said relative position of said press ram.

7. The manually operated press of claim 6, wherein a control unit is provided coupled to said clutch and, further, to said second sensor for supplying clutch signals to said clutch.

8. The manually operated press of claim 7, wherein said control unit supplies a clutch signal for keeping said clutch closed when said sensed relative displacement position of said press ram is smaller than a predetermined threshold value.

9. The manually operated press of claim 7, wherein said control unit supplies a clutch signal for opening said clutch when said relative displacement position of said press ram is greater than or equal to a predetermined threshold value.

10. The manually operated press of claim 1, wherein said first clutch comprises a brake disc and a brake magnet.

11. The manually operated press of claim 1, wherein said actuation member is secured against rotation to said input shaft.

12. The manually operated press of claim 1, wherein said press ram is constantly operatively connected to said output shaft.

13. The manually operated press of claim 1, wherein, further, a stroke stop is provided for immobilizing said input shaft.

14. The manually operated press of claim 10, wherein said brake disc is secured against rotation to said input shaft, said brake magnet being secured to said press in a stationary manner such that said input shaft is adapted to be immobilized.

15. The manually operated press of claim 10, wherein, further, a third sensor is provided for sensing said relative displacement position of said input shaft, wherein said brake disc is configured such that said third sensor senses said relative displacement position in cooperation with said brake disc.

16. The manually operated press of claim 1, wherein, further, a return assembly is provided being coupled to said input shaft for moving said actuation member into an initial position.

17. The manually operated press of claim 16, wherein said return assembly is configured as a spring.

18. The manually operated press of claim 6, wherein said second sensor is a linear incremental displacement position measuring system sensing displacement position marks coupled to said press ram.

19. The manually operated press of claim 1, wherein said first and said second shaft are interconnected by said clutch in a form-fitting manner for transforming said stroke movement.

20. The manually operated press of claim 19, wherein said form-fitting connection is achieved by means of a toothing having a latch position.

21. A method for protecting a manually operated press against mechanical overload, said press having a manual actuation member coupled to a shaft, a manual actuation of said actuation member being transformed into a stroke movement of a press ram coupled to said shaft and, accordingly, into a change of a relative displacement position of said press ram, said press ram is configured to press a work piece positioned on a base, and a clutch assembly for interrupting a flow of force between said actuation member and said press ram, wherein said shaft has at least two separated pieces, said at least two separated pieces comprises an input shaft and an output shaft, said input shaft extending as an inner shaft through said output shaft, said output shaft is configured as a hollow shaft, said clutch assembly having a first clutch designed as a stroke stop for immobilizing said input shaft with a housing of said press depending on at least one press parameter of a group of press parameters comprising pressing force and relative displacement position of said press ram, and a second clutch designed as an overload clutch for interrupting a flow of force between said input shaft and said output shaft, the method comprising the steps of:

closing said first clutch;

closing said second clutch;

sensing at least one of said press parameters;

determining whether said press parameter has reached a predetermined threshold value; and if said predetermined threshold value has been reached, actuating said second clutch for separating said input and output shafts from each other.

22. The method of claim 21, wherein a stroke stop is closed before said second clutch separates said shafts.

* * * * *